US009852852B2

(12) United States Patent
Le et al.

(10) Patent No.: US 9,852,852 B2
(45) Date of Patent: Dec. 26, 2017

(54) SAFETY SWITCHING APPARATUS WITH SWITCHING ELEMENT IN THE AUXILIARY CONTACT CURRENT PATH

(71) Applicant: Pilz GmbH & Co. KG, Ostfildern (DE)

(72) Inventors: Kim Le, Ostfildern (DE); Sebastian Richter, Ostfildern (DE)

(73) Assignee: PILZ GMBH & CO. KG, Ostfildern (DE)

( * ) Notice: Subject to any disclaimer, the term of this patent is extended or adjusted under 35 U.S.C. 154(b) by 311 days.

(21) Appl. No.: 14/504,851

(22) Filed: Oct. 2, 2014

(65) Prior Publication Data

US 2015/0015089 A1 Jan. 15, 2015

Related U.S. Application Data

(63) Continuation of application No. PCT/EP2013/056517, filed on Mar. 27, 2013.

(30) Foreign Application Priority Data

Apr. 5, 2012 (DE) ..... 10 2012 103 015

(51) Int. Cl.
*H01H 83/00* (2006.01)
*H01H 9/54* (2006.01)
(Continued)

(52) U.S. Cl.
CPC ..... *H01H 9/54* (2013.01); *H01H 9/0271* (2013.01); *H01H 47/004* (2013.01); *H01H 2300/026* (2013.01); *Y10T 307/826* (2015.04)

(58) Field of Classification Search
CPC ..... H01H 9/54; H01H 9/0271; H01H 47/004; H01H 2300/026; Y10T 307/826
(Continued)

(56) References Cited

U.S. PATENT DOCUMENTS 6,570,272 B2 5/2003 Dickhoff
6,809,911 B2 10/2004 Dickhoff et al.
(Continued)

FOREIGN PATENT DOCUMENTS

DE 199 44 461 A1 1/2001
DE 199 54 460 A1 9/2001
(Continued)

OTHER PUBLICATIONS

Chinese Search Report for Appl'n No. 201380024217.X; dated Dec. 14, 2015; 2 pp.
(Continued)

*Primary Examiner* — Daniel Cavallari
(74) *Attorney, Agent, or Firm* — Harness, Dickey & Pierce, P.L.C.

(57) ABSTRACT

A safety switching apparatus for switching on or off a technical installation has a failsafe control/evaluation unit with an input for receiving an input signal. The failsafe control/evaluation unit is designed to process the input signal in order to produce an output signal for switching on or off the technical installation at a defined output signal time. The failsafe control/evaluation unit has a first output for transmitting the output signal to an electromechanical switch. The electromechanical switch has an operating contact for switching a load circuit of the technical installation and has a positively guided auxiliary contact in an auxiliary contact current path. The auxiliary contact can be used to carry a current for checking the switching position of the operating contact. A switching element is arranged in the auxiliary contact current path. The failsafe control/evaluation unit is designed to produce a switching signal at a defined switching signal time which has a time gap relative to the output signal time. The failsafe control/evaluation unit has a second output for transmitting the switching signal to
(Continued)

the switching element in order to selectively allow or disallow the current through the auxiliary contact current path.

13 Claims, 9 Drawing Sheets

(51) Int. Cl.
*H01H 47/00* (2006.01)
*H01H 9/02* (2006.01)

(58) Field of Classification Search
USPC ..... 307/326–328
See application file for complete search history.

(56) References Cited

U.S. PATENT DOCUMENTS

| | | | | |
|---|---|---|---|---|
| 6,813,132 | B1 * | 11/2004 | Mitlmeier | H01H 47/002 361/160 |
| 7,948,391 | B2 | 5/2011 | Pullmann et al. | |
| 2002/0130557 | A1 * | 9/2002 | Dickhoff | H01H 47/004 307/113 |
| 2005/0057868 | A1 | 3/2005 | Pullmann et al. | |
| 2007/0090694 | A1 | 4/2007 | Pullmann et al. | |

FOREIGN PATENT DOCUMENTS

| | | | |
|---|---|---|---|
| DE | 100 37 383 | A1 | 2/2002 |
| DE | 10 2004 020 995 | A1 | 11/2005 |
| DE | 10 2004 033 359 | A1 | 2/2006 |
| DE | 10 2007 052 512 | B3 | 4/2009 |
| EP | 2 053 625 | A1 | 4/2009 |
| JP | 2007-532838 | | 11/2007 |
| WO | 01/37302 | A1 | 5/2001 |

OTHER PUBLICATIONS

DIN EN 954-1; Safety-related parts of control systems—Part 1: General principles for design; Mar. 1997; 34 pp.
EN ISO 13849-1; Safety of Machine—Safety-related parts of control systems—Part 1: General principles for design; Nov. 2006; 97 pp.
PSSuniversal—System Description—No. 21256-EN-04; Oct. 2010; 89 pp.
PNOZ mm0p—Operating Manual—No. 1001274-EN-04; Oct. 2011; 43 pp.
ZVEI: Automation; Safety of machinery—Notes on the application of standards EN 62061 and EN ISO 13849-1; Jun. 2007; 19 pp.
ISA/EP; International Search Report; dated Oct. 7, 2013; 3 pp.
English translation of International Preliminary Report on Patentability (Chapter 1); issued by WIPO dated Oct. 7, 2014; 11 pp.
Japanese Examination Report for Appl'n No. 2015-503824 (English translation attached); dated Jun. 29, 2017; 6 pp.

* cited by examiner

SAFETY SWITCHING APPARATUS WITH SWITCHING ELEMENT IN THE AUXILIARY CONTACT CURRENT PATH

CROSS REFERENCES TO RELATED APPLICATIONS

This application is a continuation of international patent application PCT/EP2013/056517 filed on Mar. 27, 2013 designating the U.S., which international patent application has been published in German language and claims priority from German patent application DE 10 2012 103 015.4 filed on Apr. 5, 2012. The entire contents of these priority applications are incorporated herein by reference.

BACKGROUND OF THE INVENTION

The present invention relates to a safety switching apparatus and a method for switching on or switching off a technical installation in a failsafe manner, and more particularly, to a safety switching apparatus and method that operate more efficiently in terms of energy consumption and power saving.

A safety switching apparatus in terms of the present invention is any switching apparatus that is designed to meet the safety standards for industrial machines, such as EN ISO 13849 and/or EN/IEC 62061 or related safety standards. Particularly, a safety switching apparatus in terms of the present invention is designed to meet the requirements of PL d (Performance Level d) according to EN ISO 13849 and/or SIL 2 (Safety Integrity Level) based on EN/IEC 62061. This includes safety relays, safety controllers, and also sensor and actuator modules which are used for controlling and performing safety critical tasks in the field of industrial production environments. For example, safety relays are known which monitor the operating position of an emergency off button or a guard door or, by way of example, the operational state of a light barrier and take this as a basis for disconnecting a load current into a machine or a machine area. Failure of such safety switching apparatuses can have life endangering consequences for machine personnel, for which reason safety switching apparatuses are typically used only when they are certified by relevant supervisory authorities, such as occupational health organizations.

DE 10 2004 033 359 A1 discloses a prior art system for safeguarding an automatically operating robot. The apparatus comprises a safety switching apparatus which actuates two external switching elements at the output. At the input, the safety switching apparatus is provided with one or more input signals by appropriately connected signal generators. The input signal(s) received is/are supplied to an evaluation and control unit, which is preferably designed to have multichannel redundancy. In the preferred exemplary embodiment, the safety switching apparatus comprises two output relays, the switching position of which is determined by the evaluation and control unit. Each relay has a number of positively guided make and break contacts.

In safety engineering, the electromechanical switch, for example a relay or contactor, usually has an operating contact, also called a make contact, and an auxiliary contact that is positively guided in respect thereof, also called a break contact. In this connection, positively guided means that the operating contact and the auxiliary contact are mechanically connected to one another such that the operating contact and the auxiliary contact can never be closed at the same time. In other words, the auxiliary contact (or break contact) is closed when the operating contact (or make contact) is open, and vice versa. The operating contact is arranged in the load current path or load circuit of the technical installation, as a result of which it can switch the current for the technical installation on or off. The auxiliary contact is arranged in a separate auxiliary contact current path or auxiliary contact circuit, sometimes called a feedback loop or External Device Monitoring (EDM). A current or a signal in the auxiliary contact current path allows the switching position of the operating contact to be checked, for example by a read back logic unit, on the basis of the positive guiding between the operating contact and the auxiliary contact.

The electromechanical switch having the operating contact and the auxiliary contact may be arranged remote from the safety switching apparatus and be connected via lines. Alternatively, the electromechanical switch may be accommodated within the safety switching apparatus or its housing, respectively.

DE 199 54 460 A1 discloses a safety switching device for switching on and safely switching off an electrical load, particularly an electrically driven machine, comprising a first and a second electromechanical switching element, the operating contacts of which are arranged in series with one another between a first input terminal and an output terminal of the safety switching device. Furthermore, each of the two switching elements has an auxiliary contact which is positively guided with the respective operating contacts. The auxiliary contacts of the two switching elements are likewise connected up in series with one another. Using a current which is carried via the auxiliary contacts, it is therefore possible to check the switching position of the operating contacts of the switching elements without taking direct action in the sphere of operation of the switching elements.

A user guide titled "PNOZmm0p, Configurable Control System PNOZmulti, Operating Manual—No. 1001274 EN 04" discloses a safety switching apparatus which is offered and sold by the applicant of the present invention under the trademark PNOZ®. At each safety output O0, O1, O2, O3 with extended error recognition, two loads may be connected for applications according to EN IEC 62061, SIL CL 3. A prerequisite for this, inter alia, is that a feedback loop be connected to an input.

The user guide "PSSuniversal, Programmable control systems PSS®, System Description—No. 21256 EN 04" discloses a safety switching apparatus which is offered and sold by the applicant of the present invention under the trademark PSS®. This apparatus has a feedback loop input (EDM input) and a feedback loop logic unit (EDM logic unit).

For all kinds of electrical devices, energy consumption is an issue that gets more and more attention. Up to now, however, safety switching apparatuses of the prior art have not addressed this issue with all its consequences.

SUMMARY OF THE INVENTION

Against this background, it is an object of the present invention to provide a safety switching apparatus and a method of the type mentioned at the outset which operate with less energy consumption and/or provide greater energy saving energy efficiency.

According to a first aspect of the invention, there is provided a safety switching apparatus for switching on or off a technical installation in a failsafe manner, comprising a failsafe control/evaluation unit having an input for receiving an input signal representative of the technical installation and having a first output for providing an output signal as a function of the input signal, comprising an electromechanical switch having an operating contact for connecting or disconnecting a load current to the technical installation, and having an auxiliary contact mechanically coupled with the operating contact in order to establish an auxiliary contact current path which is electrically isolated from the operating contact, and comprising a switching element arranged in the auxiliary contact current path, wherein the first output is coupled to the electromechanical switch for driving the operating contact in response to the output signal at a defined output signal time, wherein the failsafe control/evaluation unit is designed for checking the switching position of the operating contact by monitoring the auxiliary contact current path, wherein the failsafe control/evaluation unit is further designed to produce a switching signal at a defined switching signal time which is different from the output signal time, and wherein the switching element is driven in response to the switching signal in order to selectively allow or interrupt an auxiliary current flow in the auxiliary contact current path.

According to a further aspect of the invention, there is provided, in a technical installation comprising an electrical load selectively supplied with a load current, comprising least one signaling device for providing an input signal and comprising an electromechanical switch having an operating contact for connecting or disconnecting the load current and having an auxiliary contact mechanically coupled with the operating contact in order to establish an auxiliary contact current path which is electrically isolated from the operating contact, a safety switching apparatus comprising a failsafe control/evaluation unit having an input for receiving the input signal and having a first output for providing an output signal as a function of the input signal, and comprising a switching element arranged in the auxiliary contact current path, wherein the first output is coupled to the electromechanical switch for driving the operating contact in response to the output signal at a defined output signal time, wherein the failsafe control/evaluation unit is designed for checking the switching position of the operating contact by monitoring the auxiliary contact current path, wherein the failsafe control/evaluation unit is further designed to produce a switching signal at a defined switching signal time which is different from the output signal time, and wherein the switching element is driven in response to the switching signal in order to selectively allow or interrupt an auxiliary current flow in the auxiliary contact current path.

According to yet another aspect, there is provided a method for operating a failsafe control/evaluation unit of a safety switching apparatus comprising the following steps of receiving an input signal at an input of the failsafe control/evaluation unit, processing the input signal in order to produce, in dependence thereon, an output signal for switching on or off a load current at a defined output signal time, and transmitting the output signal to an electromechanical switch, wherein the electromechanical switch has an operating contact for switching a load circuit of the technical installation and has a positively guided auxiliary contact in an auxiliary contact current path, which can be used to carry a current for checking the switching position of the operating contact, producing a switching signal at a defined switching signal time which has a time gap relative to the output signal time, and transmitting, from a second output of the control/evaluation unit, the switching signal to a switching element arranged in the auxiliary contact current path in order to selectively allow a monitoring current through the auxiliary contact current path.

The novel safety switching apparatus uses an additional switching element in the auxiliary contact current path or auxiliary contact circuit, which switching element is actuated by the control/evaluation unit. The switching element is particularly arranged in series with the auxiliary contact. Appropriate switching of the switching element under the control of the control/evaluation unit can thus achieve the effect that a current flows in the auxiliary contact current path only at particular times, and not permanently. The current in the auxiliary contact current path can therefore be switched on only when it is needed. This results in lower current consumption and/or heat generation in the auxiliary contact current path, for example via a load element. Hence, a more energy saving or more energy efficient safety switching apparatus is provided.

In prior art safety switching apparatuses, a current flows permanently in the auxiliary contact current path, for example via a load element for setting a defined current. This is the case particularly when the technical installation is switched off for a relatively long time, that is to say that the operating contacts in the load circuit of the technical installation are open and the auxiliary contacts that are positively guided in respect thereof are therefore closed. This permanent current results in increased current draw and additional heat generation.

Overall, the novel safety switching apparatus, the novel safety switching system and the novel method therefore allow increased energy saving or energy efficiency.

In a refinement, the failsafe control/evaluation unit is designed so that, when it produces, at a first output signal time, the output signal in the form of a switch on signal for switching on the technical installation, it produces the switching signal in the form of a switch on signal for switching on the switching element at a first switching signal time, which is before the first output signal time.

In this refinement, a current can flow via the auxiliary contact current path only briefly when or before the technical installation is switched on. The current thus flows only when it is needed, such as for checking the switching position of the operating contact or switching on the technical installation or dangerous machine. A current consumption and/or heat generation is/are achieved only when the technical installation is switched on. In particular, the switching element is designed to switch on the current through the auxiliary contact current path when the switching signal is received.

In a variant of this refinement, the failsafe control/evaluation unit is designed to produce a further switching signal in the form of a switch off signal for switching off the switching element at a further switching signal time, which is after the first output signal time.

In this variant, the switching element is switched off again when it is no longer needed. This results in a further reduced current consumption and/or heat efficiency, particularly when other elements are also actuated by the switching element, such as a plurality of auxiliary contact current paths of the plurality of electromechanical switches.

In an alternative or additional refinement, the failsafe control/evaluation unit is designed so that, when it produces, at a second output signal time, the output signal in the form of a switch off signal for switching off the technical installation, it produces the switching signal in the form of a switch off signal for switching off the switching element at a second switching signal time, which is after the second output signal time.

In this refinement, a current can be supplied to the auxiliary contact current path only briefly when or after the installation is switched off. The current therefore flows only when it is needed, for example for checking the switching position of the operating contact or reading back after the machine is switched off. Thus, a reduced current consumption and/or heat generation is/are provided when the machine is switched off. In particular, the switching element is designed to switch off the current through the auxiliary contact current path when the switch off signal is received.

In a variant of this refinement, the failsafe control/evaluation unit is designed to produce a further switching signal in the form of a switch on signal for switching on the switching element at a further switching signal time, which is before the second output signal time.

In this variant, the switching element is switched on again before it is needed again, and in this way a further reduced current consumption and/or heat generation is/are provided, particularly when other elements are also actuated by the switching element, such as a plurality of auxiliary contact current paths of the plurality of electromechanical switches.

In a further refinement, the failsafe control/evaluation unit has at least two first outputs each for transmitting a respective output signal to a respective electromechanical switch, wherein particularly the switching element is arranged in each of the auxiliary contact current paths of the auxiliary contacts of the electromechanical switches.

In this refinement, a single switching element is used for auxiliary contact current paths of a plurality of electromechanical switches. Thus, a simple and inexpensive implementation is provided. This refinement can be used particularly in conjunction with the aforementioned switching off again after the current is no longer needed and/or in conjunction with the aforementioned switching on again as soon as the current is needed again. In this case, an even lower current consumption and/or heat efficiency is/are achieved.

In a further refinement, the failsafe control/evaluation unit has at least two first outputs each for transmitting a respective output signal to a respective electromechanical switch, wherein particularly the safety switching apparatus has at least two switching elements which are respectively arranged in one of the auxiliary contact current paths from the auxiliary contact current paths of the auxiliary contacts of the electromechanical switches.

In this refinement, a respective switching element is used for each auxiliary contact current path of each of a plurality of electromechanical switches. The current consumption or the energy can thus be lowered to the maximum.

In a further refinement, the safety switching apparatus has a read back logic unit having an input, connected to the auxiliary contact current path, for receiving a read back signal for checking the switching position of the operating contact.

In this refinement, the read back logic unit allows a check to determine whether the electromechanical switch is working as intended or is welded, for example. This provides increased safety. The read back logic unit may be implemented in the control/evaluation unit or in a separate processing unit. The read-back logic unit may have a read-back circuit connected upstream of it which has a voltage matching unit and/or a filter.

In a variant of this refinement, the read back logic unit is designed to check the switching position of the operating contact at a first read back time, which is before the first output signal time, and in particular is after the first switching signal time.

In this variant, the electromechanical switch can be checked before the technical installation is switched on. It is possible to check whether the operating contact has actually closed or switched on and is not welded, for example. The first read-back time may be between the first switching signal time and the first output signal time, in particular. This makes use of the period in which the switching element is switched on but the auxiliary contact is not yet open.

In an alternative or additional variant, the read back logic unit is designed to check the switching position of the operating contact at a second read back time, which is after the second output signal time, and in particular is before the second switching signal time.

In this variant, it is possible for the electromechanical switch to be checked after it is switched off. It is thus possible to check whether the operating contact has actually opened or switched off and is not welded, for example. The second read back time may be between the second output signal time and the second switching signal time, in particular. This makes use of the period in which the switching element is switched on and the auxiliary contact is open again.

In a further refinement, the safety switching apparatus has a load element, arranged in the auxiliary contact current path, for setting a defined current through the auxiliary contact current path when a defined voltage is applied.

In this refinement, a defined current can be provided in the auxiliary contact current path, in particular which corresponds to or exceeds a minimum current or a minimum power. Only if this minimum current or minimum power is present or exceeded is it possible to guarantee a low contact resistance for the auxiliary contact. Therefore, improved contact certainty is provided. The minimum current or the minimum power is a property of the respective auxiliary contact and can be specified by the manufacturer of the electromechanical switch, for example. In particular, the load element may be dimensioned such that the minimum current and/or the minimum power is ensured. The current consumption and/or the heat efficiency of the load element is dependent on the respective load element chosen. The load element may be a load resistor, in particular. This provides a simple and inexpensive way of setting the defined current. Alternatively, however, any other suitable load element may also be used, such as a current sink (for example electronic load).

In a further refinement, the switching element is an electronic switching element, particularly a transistor.

The effect achieved by this refinement is that the switching element or the transistor switches much more quickly than the electromechanical switch. The interval of time between the switching signal time and the output signal time may therefore be very much shorter than the maximum switching frequency of the electromechanical switch.

In a further refinement, the safety switching apparatus comprises the electromechanical switch.

In this refinement, the electromechanical switch is part of the safety switching apparatus. In particular, the electromechanical switch may be arranged within the housing of the safety switching apparatus. By way of example, there may be an output terminal on the housing, which output terminal can be connected to the load circuit of the technical installation. This allows the technical installation to be switched on or off directly. It is therefore possible to provide a compact safety switching apparatus. The safety switching apparatus can be connected to the load circuit directly.

In a further refinement, the safety switching apparatus has an output terminal, which is arranged on a housing of the safety switching apparatus and which is connected to the first output, for actuating the electromechanical switch.

In this refinement, the electromechanical switch is not part of the safety switching apparatus and is not arranged within the housing of the safety switching apparatus. This allows the technical installation to be switched on or off indirectly. The electromechanical switch may be arranged in a switching apparatus which is arranged so as to be physically isolated, or is separate, from the safety switching apparatus. The safety switching apparatus and the switching apparatus together then form the safety switching system. The switching apparatus arranged so as to be physically isolated may have an input terminal, arranged on a housing of the switching apparatus, for receiving the output signal. The use of a physically isolated switching apparatus thus provides increased safety, particularly in the case of relatively high currents to be switched, such as when contactors are used.

It goes without saying that the features cited above and those which are still to be explained below can be used not only in the respectively indicated combination but also in other combinations or on their own without departing from the scope of the present invention.

BRIEF DESCRIPTION OF THE DRAWINGS

Exemplary embodiments of the invention are shown in the drawing and are explained in more detail in the description below. In the drawing.

DESCRIPTION OF PREFERRED EMBODIMENTS

Figure 1:
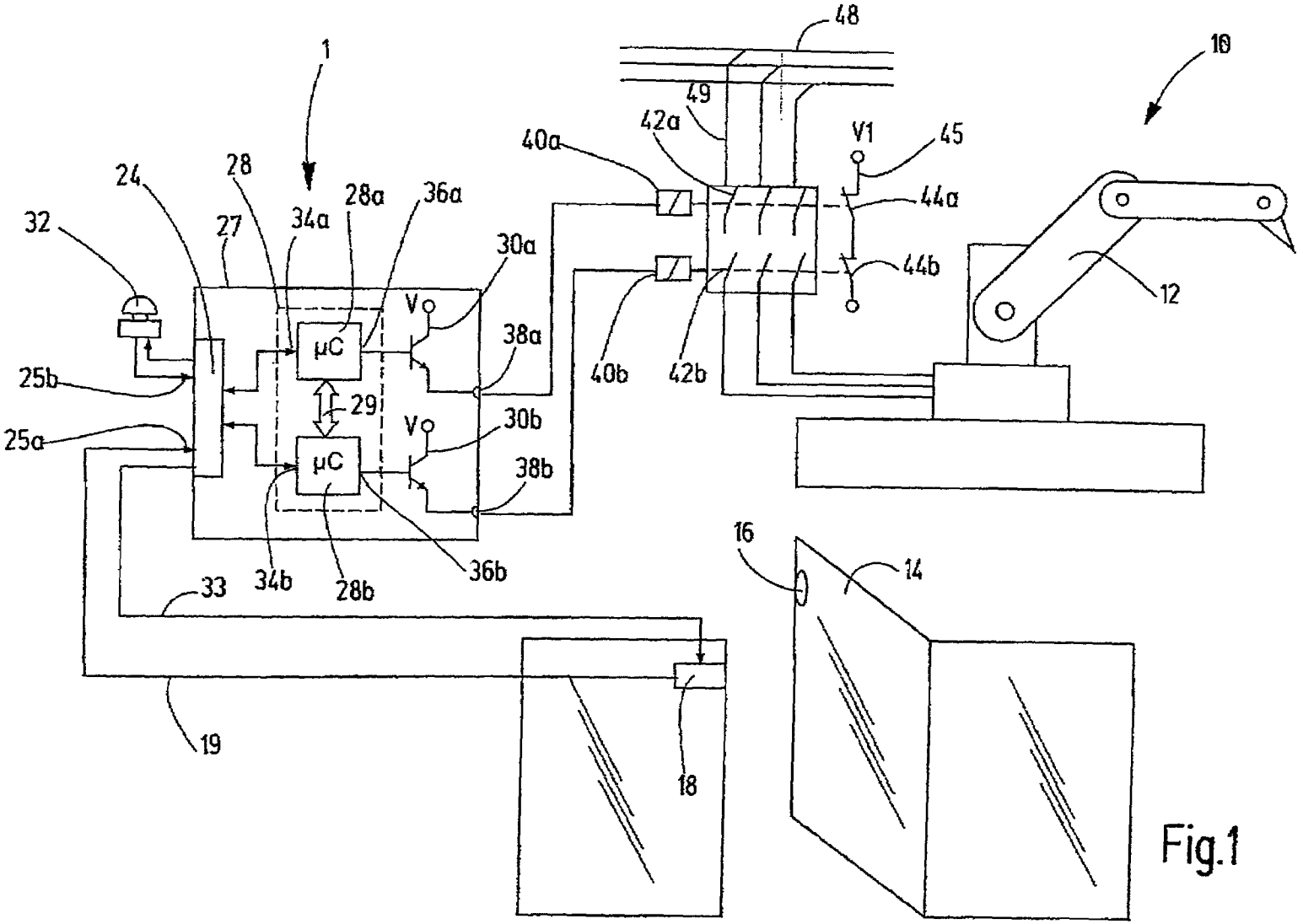
FIG. 1 shows a simplified illustration of a technical installation with an exemplary embodiment of the safety switching apparatus.

FIG. 1 illustrates a technical installation 10 having an exemplary embodiment of the safety switching apparatus 1 for switching on or off the technical or dangerous installation 10 in a failsafe manner. In this exemplary embodiment, the installation 10 includes, by way of example, a robot 12, the movements of which during working operation present a danger to persons who are in the working area of the robot 12. For this reason, the working area of the robot 12 is safeguarded by means of a protective fence having a guard door 14. The guard door 14 allows access to the working area of the robot 12, for example for maintenance work or for setup work. During normal working operation, the robot 12 is permitted to work only when the guard door 14 is closed, however. As soon as the guard door 14 is opened, the robot 12 must be disconnected or put into a safe state in another manner.

In order to detect that the guard door 14 is in the closed state, the guard door 14 has a guard door switch mounted on it which has a door portion 16 and a frame portion 18. The frame portion 18 produces a guard door signal on a line 20, said signal being supplied to the novel safety switching apparatus 1 via line 19.

In this exemplary embodiment, the safety switching apparatus 1 has an I/O portion 24 having a plurality of connections (external or device connections) 25. In some exemplary embodiments, the connections 25*a*, 25*b* are connecting terminals or field terminals which are arranged on one housing side of the housing 27 of the safety switching apparatus 1. By way of example, there may be tension spring terminals or screw terminals. In other exemplary embodiments, the connections may be plugs or sockets which contain a plurality of contact elements (pins), with one pin in each case forming one connection. Frequently, M8 sockets having five contact pins are used for connection of signaling devices or other sensors at field level. Accordingly, exemplary embodiments of the novel safety switching apparatus may be or may comprise field devices which are arranged outside a switchgear cabinet in close proximity to the robot 12.

The safety switching apparatus 1 has a failsafe control/evaluation unit 28. In this exemplary embodiment, the safety switching apparatus 1 has two redundant signal processing channels. By way of example, two processing units or microcontrollers 28*a*, 28*b* are shown here, each being connected to the I/O portion 24 or the connections 25*a*, 25*b*. In this case, the microcontrollers 28*a*, 28*b*—redundantly with respect to one another—process the input signals which are applied to the inputs 34*a*, 34*b* and which the safety switching apparatus 1 picks up at the device connections 25*a*, 25*b* or inputs of the I/O portion 24, and they compare their results, as shown by an arrow 29. Instead of two microcontrollers 28*a*, 28*b*, it is possible to use microprocessors, ASICs, FPGAs and/or other signal processing circuits. Preferably, exemplary embodiments of the safety switching apparatus 1 therefore have at least two signal processing channels which are redundant with respect to one another and which are each capable of logically combining signals in order to take this as a basis for producing an output signal at a respective output 36*a*, 36*b*. This output signal is then used in order to actuate a switching element 30*a*, 30*b* or an electromechanical switch 40*a*, 40*b* to disconnect the technical installation 10 or the robot 12. Such a safety switching apparatus 1 can then be used to disconnect the installation 10, in this case the robot 12, in a failsafe manner (FS).

In the case presented here, the safety switching apparatus 1 has two redundant switching elements 30*a*, 30*b*, in this case electronic switching elements 30*a*, 30*b* in the form of transistors. Each of these two switching elements is capable of connecting a high voltage potential V to a device connection 38*a*, 38*b* of the safety switching apparatus 1 in order to allow a flow of current to an electromechanical switch 40*a*, 40*b*, or to interrupt this flow of current. Hence, each of the switching elements 30 can disconnect an electromechanical switch 40, such as a contactor.

The electromechanical switches 40*a*, 40*b* each have an operating contact 42*a*, 42*b*. The operating contacts 42*a*, 42*b* are in this case arranged in series with one another in a current supply path or load circuit 49 from a power supply 48 to the robot 12. In addition, the electromechanical switches 40*a*, 40*b* each have an auxiliary contact 44*a*, 44*b* which is positively guided in respect of the relevant operating contact 42*a*, 42*b*. In this case, the auxiliary contacts 44*a*, 44*b* are arranged in series with one another in an auxiliary contact current path 45 having an applied voltage V1. The voltage V1 of the auxiliary circuit may be 24V, for example. The voltage of the load circuit may be higher. As soon as the safety switching apparatus 1 disconnects the electromechanical switches 40*a*, 40*b*, the operating contacts 42 drop and the power supply for the robot 12 is disconnected. It is clear to a person skilled in the relevant art that such "radical" disconnection is described here by way of example. As a departure therefrom, a safety requirement may involve only portions of the robot 12 being disconnected, such as the dangerous drives, while other portions of the robot 12 remain operational. Delayed disconnection is also conceivable so that the robot 12 can be slowed down in controlled fashion, if appropriate, before the drives are disconnected.

The safety switching apparatus 1 actuates the switching elements 30*a*, 30*b* in this case on the basis of the input signal from the guard door switch on the line 19 at the connection or input 25*a* and on the basis of a further input signal from an emergency off pushbutton 32 at the connection or input 25*b*, for example. The emergency off pushbutton 32 is also connected by means of lines to device connections of the safety switching apparatus 1. Preferably, each of the input signals can be applied in redundant form, or there may be two input and output lines or connections provided in each case (not shown in FIG. 1). In the example shown in FIG. 1, the emergency off pushbutton 32 may thus have two input lines or inputs 25*b* provided which each deliver an input signal from the emergency off pushbutton switch 32. A similar situation applies to the signal from the guard door switch.

In some exemplary embodiments, the safety switching apparatus 1 produces output signals which are supplied to the individual signaling devices. By way of example, such an output signal is carried by means of a line 33 to the frame portion 18 of the guard door switch. The frame portion 18 loops the output signal from the safety switching apparatus 1 from the line 33 to the line 19 when the door portion 16 is in proximity to the frame portion 18, that is to say when the guard door 14 is closed. Therefore, the safety switching apparatus 1 can monitor the guard door switch using the output signal on the line 33 and using the input signal on the line 19. In comparable fashion, the safety switching apparatus 1 in this case monitors the emergency off pushbutton 32.

As a departure from the illustration in FIG. 1, two redundant output signals from the safety switching apparatus 1 are frequently used in practice, each being carried by means of a separate signal line to a signaling device and being looped back to the safety switching apparatus 1 by means of said signaling device. As an example of such an implementation, reference may be made to US 2007/090694 A1, which is incorporated by reference for the details of such redundant monitoring of a signaling device. The emergency off pushbutton 32 is also frequently monitored using redundant input and output lines in practice, as mentioned above.

Figure 2:
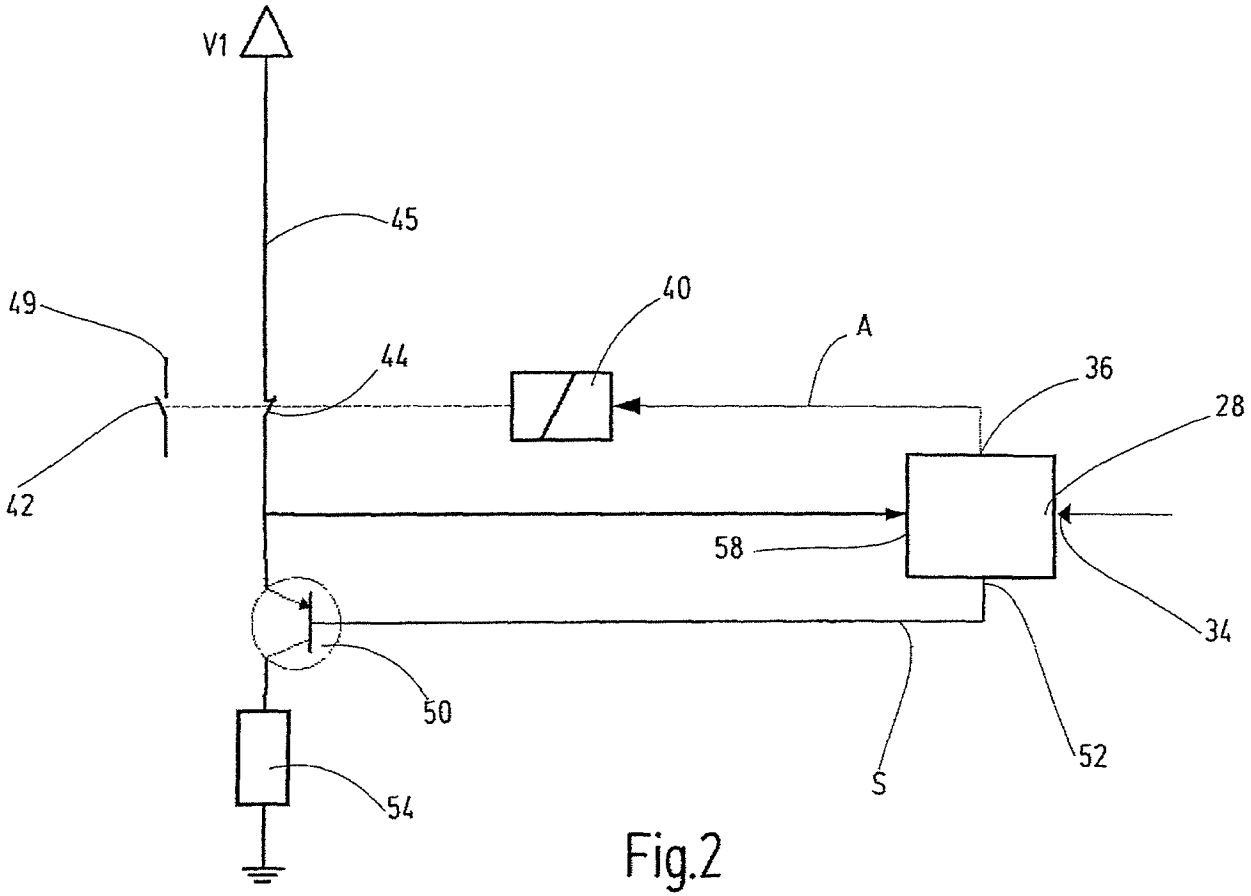
FIG. 2 shows a simplified illustration of a first exemplary embodiment of the novel safety switching apparatus.

FIG. 2 shows a simplified illustration of a first exemplary embodiment of the novel safety switching apparatus 1, for example the safety switching apparatus described with reference to FIG. 1. The failsafe control/evaluation unit 28 has a first input 34 for receiving an input signal and is designed to process the input signal in order to take this as a basis for producing, at an output signal time, an output signal A for switching on or off the technical installation 10. The failsafe control/evaluation unit 28 accordingly has a first output 36 for transmitting the output signal A to an electromechanical switch 40. FIG. 2 shows an appropriate connection or line between the first output 36 and the electromechanical switch 40. The electromechanical switch 40 has an operating contact 42 for switching a load circuit 49 of the technical installation 10 and has a positively guided auxiliary contact 44 in an auxiliary contact current path 45. When a defined voltage V1 (e.g. 24 V) is applied, the auxiliary contact 44 or the auxiliary contact current path 45 can be used to carry a current for checking the switching position of the operating contact 42. By way of example, this can be accomplished by a read back logic unit which has a second input 58, connected to the auxiliary contact current path 45, for receiving a read back signal for checking the switching position of the operating contact 44. As can be seen in FIG. 2, a connection or line from the auxiliary contact current path 45 to the second input 58 is provided for this purpose. This allows a check to determine whether the operating contact 40 is working as intended or is welded. In the exemplary embodiment shown here, the read back logic unit is implemented in the control/evaluation unit 28. Alternatively, the read back logic unit may be implemented in a separate processing unit.

The safety switching device 1 comprises a switching element 50 arranged in the auxiliary contact current path 45. The switching element 50 is arranged in series with the auxiliary contact 44. Therefore, the current in the auxiliary contact current path is interrupted as soon as either the auxiliary contact 44 or the switching element 50 is opened. The current in the auxiliary contact current path flows only when both the auxiliary contact 44 and the switching element 50 are closed. The failsafe control/evaluation unit 28 is designed to produce a switching signal S at a switching signal time which has a time gap relative to the output signal time. The failsafe control/evaluation unit 28 has a second output 52 for transmitting the switching signal S to the switching element 50, which is designed to switch the current through the auxiliary contact current path 45 when the switching signal S is received. FIG. 2 shows an appropriate connection or line between the second output 52 and the switching element 50. The safety switching apparatus 1 thus uses an additional switching element 50 in the auxiliary contact current path 45, which switching element is actuated by the control/evaluation unit 28. By means of appropriate switching of the switching element 50 under the control of the control/evaluation unit 28, it is thus possible to achieve the effect that a current flows in the auxiliary contact current path 45 only at particular times, and not permanently. In particular, the interval of time may be short enough for no delay to occur in the switching process of the electromechanical switch 40, and/or may be long enough for an appreciable current to be able to flow in the auxiliary contact current path 45, as required for checking the switching position of the operating contact 42 or for a read back signal, for example. The interval of time between the switching signal time and the output signal time may, by way of example, be in the range of microseconds, for example between 1 and 100 microseconds, particularly between 10 and 50 microseconds, particularly between 20 and 40 microseconds.

In the exemplary embodiment shown here, the switching element 50 is an electronic switching element in the form of a transistor. The transistor 50 can switch very much more quickly than the electromechanical switch 40. The time gap between the switching signal time and the output signal time may therefore be very much shorter than the maximum switching frequency of the electromechanical switch 40. Persons skilled in the relevant art will understand that another suitable type of switching element can also be used.

In the exemplary embodiment shown in FIG. 2, the safety switching apparatus 1 has a load element 54 arranged in the auxiliary contact current path 45 for setting a defined current through the auxiliary contact current path 45 when a defined voltage V1 is applied. It is thus possible to provide or ensure a minimum current or a minimum power for the auxiliary contact 44 in the auxiliary contact current path 45. Only if the minimum current or the minimum power is present or exceeded is it possible to guarantee a low contact resistance for the auxiliary contact 44. The load element 54 may particularly be dimensioned such that the minimum current and/or the minimum power is/are ensured. In the exemplary embodiment shown here, the load element 54 is a load resistor. Alternatively, however, it is possible to use any other suitable load element, such as a current sink (for example electronic load). By way of example, the load element can be implemented in a read back circuit. In this case, the read-back circuit would be designed to set the defined current or the minimum current or minimum power.

Figure 3:
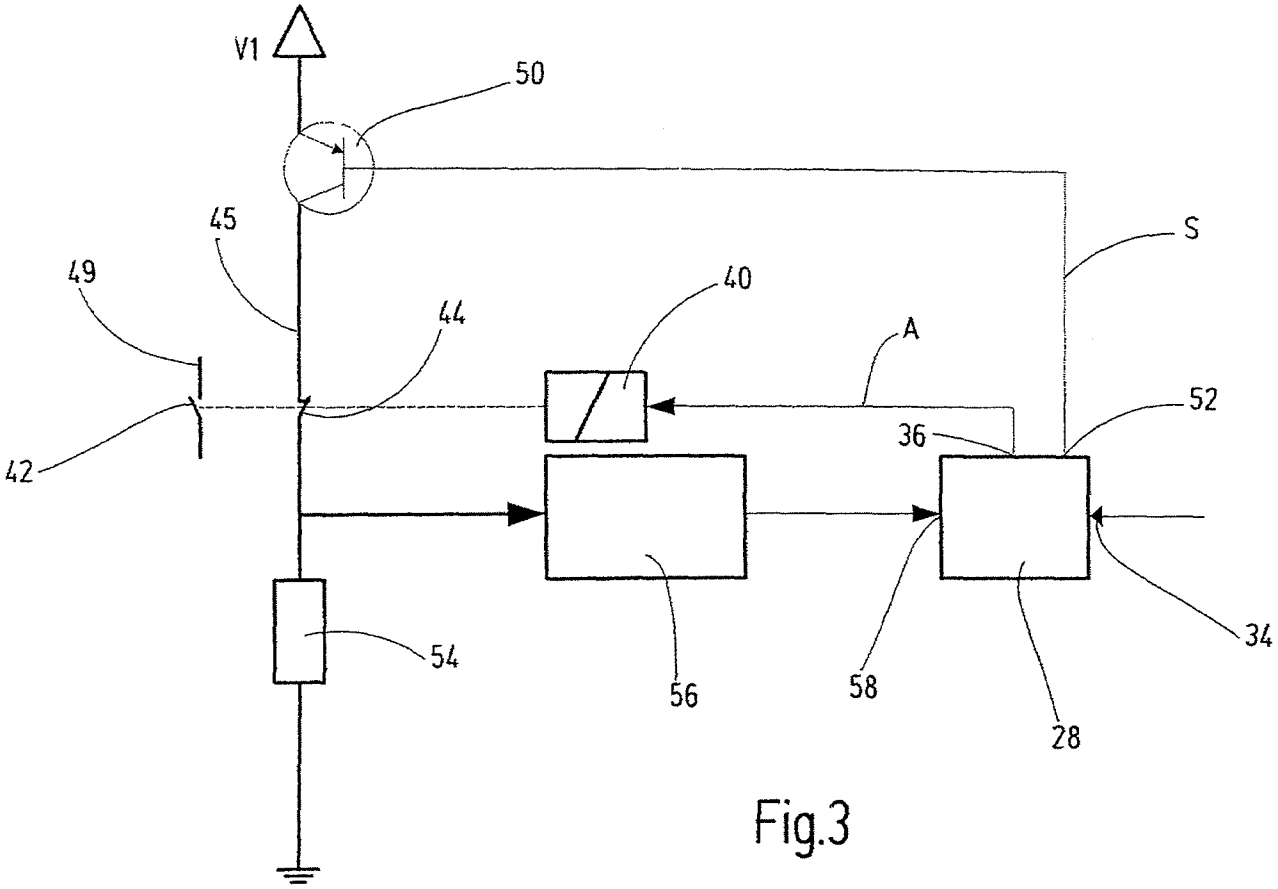
FIG. 3 shows a simplified illustration of a second exemplary embodiment of the novel safety switching apparatus.

FIG. 3 shows a simplified illustration of a second exemplary embodiment of the novel safety switching apparatus. The second exemplary embodiment in FIG. 3 is based on the first exemplary embodiment in FIG. 2, with the result that the comments relating to the exemplary embodiment in FIG. 2 also apply to the exemplary embodiment in FIG. 3. In the exemplary embodiment in FIG. 3, the transistor 50 is arranged in the auxiliary contact current path 45 above or upstream of the auxiliary contact 44, and not below or after it, as in FIG. 2. It is clear to a person skilled in the relevant art that these arrangements of the switching element or transistor in the auxiliary contact current path are interchangeable.

In the exemplary embodiment in FIG. 3, a read back circuit 56 is also connected upstream of the read back logic unit (in this case in the control/evaluation unit 28). By way of example, the read-back circuit contains voltage matching for converting the voltage V1 of the auxiliary current path 45 into a voltage which is suitable for the input 58 of the read back logic unit or the control/evaluation unit 28. By way of example, the read back circuit also contains a filter, such as a low pass filter, for filtering a possible bounce in the auxiliary contact 44.

Figure 4:
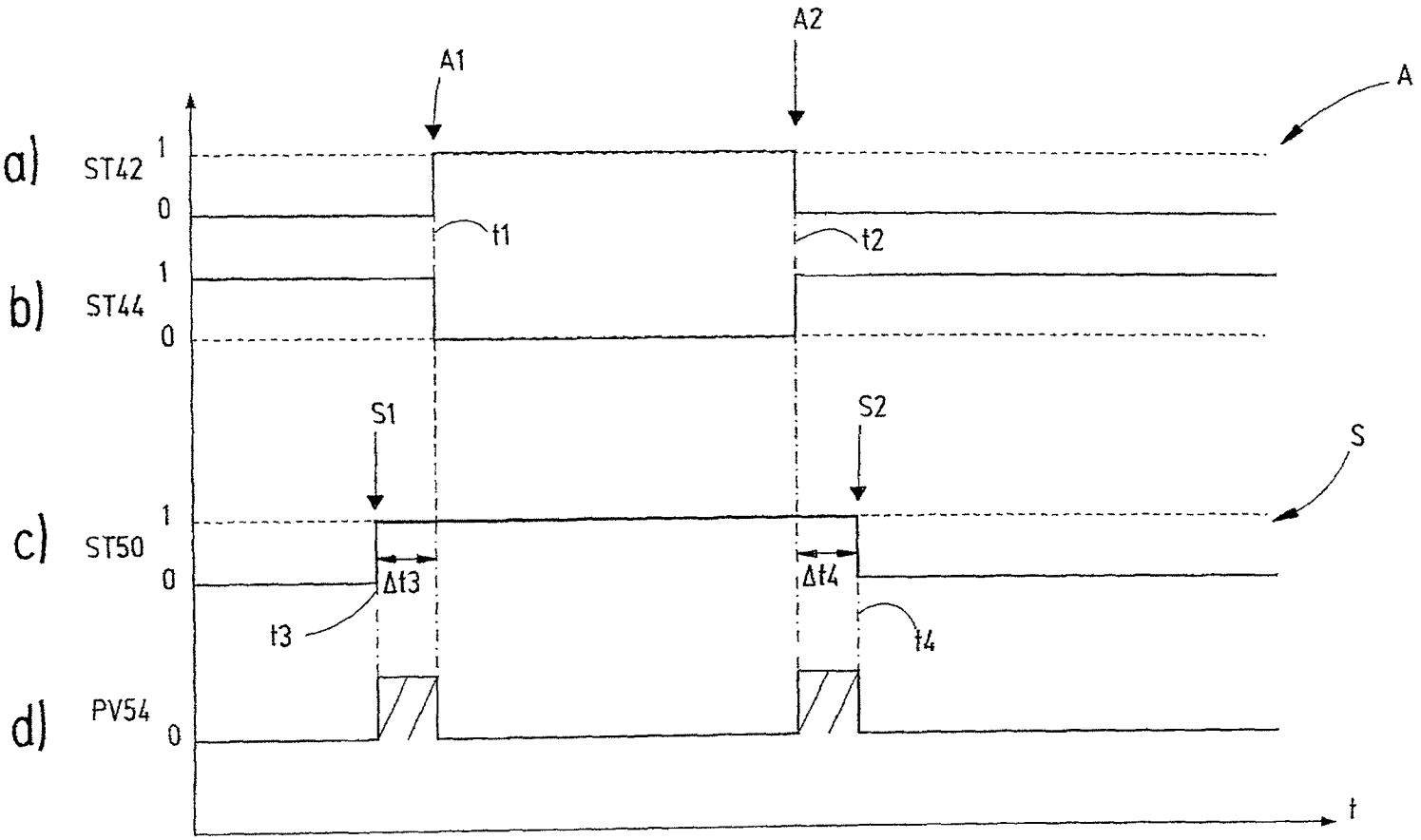
FIG. 4 shows diagrams of the time profile of states of different elements of the safety switching apparatus on the basis of a circuit diagram.

FIG. 4 shows diagrams of the time profile of states of various elements of the safety switching apparatus 1 on the basis of a circuit diagram, particularly for the safety switching apparatus 1 described previously with reference to FIG. 2 or FIG. 3. FIG. 4*a* shows the profile of the switching state ST42 of the operating contact 42 or of the output signal A over time t. The term output signal A is in this case intended to be understood to mean particularly a change or an edge in the switching state ST42. FIG. 4*b* shows a profile of the switching state ST44 of the positively guided auxiliary contact 44 over time t. FIG. 4*c* shows the profile of the switching state ST50 of the switching element 50 or of the switching signal S over time t. The term switching signal S is in this case intended to be understood to mean particularly a change or an edge in the switching state ST50. In FIGS. 4*a-c*, the state 0 respectively denotes the open state of the contact or switching element and the state 1 respectively denotes the closed state of the contact or switching element. In addition, FIG. 4*d* shows a profile of the power loss PV54 over the load element 54 over time t.

First of all, the method for operating the control/evaluation unit 28 will now be explained with reference to FIG. 4. The method first of all involves the input signal being picked up at the input 34 of the failsafe control/evaluation unit 28, the input signal being processed in order to take this as a basis for producing, at an output signal time t1, t2, the output signal A for switching on or off the technical installation 10, and, at the first output 36 of the failsafe control/evaluation unit 28, the output signal A being transmitted to an electromechanical switch 40. In the profile of the output signal A which is shown in FIG. 4*a*, the output signal A is produced at a first output signal time t1 in the form of a switch on signal A1 for switching on the technical installation. The switch on signal is in this case shown in the form of a positive edge or a change from the state 0 (open) to the state 1 (closed). At the first output signal time t1, the operating contact 42 is thus closed, as a result of which the auxiliary contact 44 that is positively guided in respect thereof is opened, as can be seen in the switching state ST44 in FIG. 4*b*. The technical installation is now switched on owing to the load circuit which has been closed by the operating contact 42. In the profile of the output signal A which is shown in FIG. 4*a*, the output signal A is then produced at a second output signal time t2 in the form of a switch off signal A2 for switching off the technical installation. The switch off signal is in this case shown in the form of a negative edge or a change from the state 1 (closed) to the state 0 (open). At the second output signal time t2, the operating contact 42 is opened again, as a result of which the auxiliary contact 44 that is positively guided in respect thereof is closed again, as can be seen in the switching state ST44 in FIG. 4*b*. The technical installation is now switched off again owing to the load circuit which has been opened by the operating contact 42.

In addition, a switching signal S is produced at a switching signal time t3, t4 at an interval of time Δt3, Δt4 from the output signal time t1, t2, as shown in FIG. 4*c*. At the second output 52 of the control/evaluation unit 28, the switching signal S is then transmitted to the switching element 50 arranged in the auxiliary contact current path 45, which switching element is designed to switch the current through the auxiliary contact current path 45 when the switching signal S is received. In FIG. 4, when the output signal A is produced at the first output signal time t1 in the form of the switch on signal A1, the switching signal S is produced in the form of a switch on signal S1 for switching on the switching element 50 at a first switching signal time t3, which is before the first output signal time t4. When the switch off signal S1 is received, the switching element 50 switches off the current through the auxiliary contact current path 45. The interval of time between the first switching signal time t3 and the first output signal time t1 is denoted by Δt3. The current in the auxiliary contact current path thus flows only between the first switching signal time t3, when the switching element 50 is closed with the auxiliary contact 44 closed, and the first output signal time A1, when the auxiliary contact 44 is opened. The current via the auxiliary contact current path can thus flow only briefly when or before the technical installation is switched on. A power loss PV54 over the load element 54 can therefore occur only between the first switching signal time t3 and the first output signal time t1, as can be seen in FIG. 4*d*.

If, on the other hand, the output signal A is produced at the second output signal time t2 in the form of the switch off signal A2, the switching signal S is produced in the form of a switch off signal S2 for switching off the switching element 50 at a second switching signal time t4, which is after the second output signal time t3. When the switch on signal S2 is received, the switching element 50 switches on the current through the auxiliary contact current path 45. The time gap between the second output signal time t2 and the second switching signal time t4 is denoted by Δt4. The current in the auxiliary contact current path thus flows only between the second output signal time t2, when the auxiliary contact 44 is closed with the switching element 50 closed, and the second switching signal time t4, when the switching element 50 is opened. The current via the auxiliary contact current path can thus flow only briefly when or after the technical installation is switched off. A power loss PV54 over the load element 54 can therefore occur only between the second switch off time t2 and the second switching signal time t4, as can be seen in FIG. 4*d*.

Figure 5:
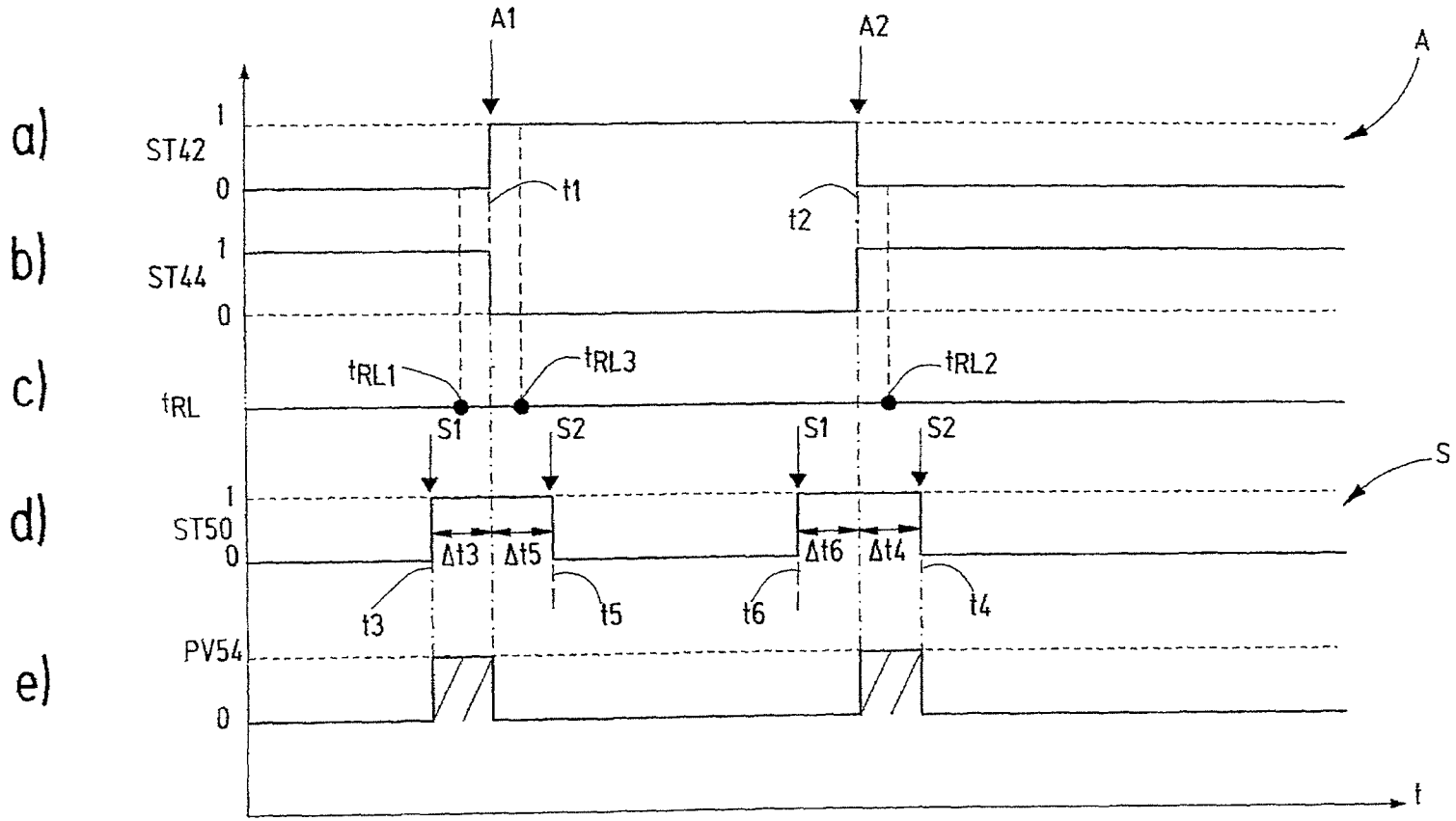
FIG. 5 shows diagrams of the time profile of states of different elements of the safety switching apparatus on the basis of a further circuit diagram.

FIG. 5 shows diagrams of the temporal profile of states of various elements of the safety switching apparatus on the basis of a further circuit diagram. The circuit diagram from FIG. 5 is based on the circuit diagram from FIG. 4, with the result that the comments relating to the circuit diagram from FIG. 4 also apply to the circuit diagram from FIG. 5. FIG. 5*a* shows the profile of the switching state ST42 of the operating contact 42 or of the output signal A over time t, and FIG. 4*b* shows the profile of the switching state ST44 of the positively guided auxiliary contact 44 over time t. FIG. 5*c* shows the read back times $t_{RL}$ of the read back logic unit. FIG. 5*d* shows the profile of the switching state ST50 of the switching element 50 or of the switching signal S over time t, and FIG. 5*e* shows the profile of the power loss PV54 over the load element 54 over time t.

In FIG. 5, a further switching signal S is produced in the form of a switch off signal S2 for switching off the switching element 50 at a further switching signal time t5, which is after the first output signal time t1. The interval of time between the first output signal time t1 and the further switching signal time t5 is denoted by Δt5. The switching element 50 is thus switched off again when it is no longer needed. In FIG. 5, a further switching signal S is also produced in the form of a switch on signal S1 for switching on the switching element 50 at a further switching signal time t6, which is before the second output signal time t2. The interval of time between the further switching signal time t6 and the second output signal time t2 is denoted by Δt6. The switching element 50 is thus switched on again before it is needed again. In the circuit diagram from FIG. 5, the switching element 50 is thus switched off after the installation is switched on, and is switched on again before the installation is switched off. Hence, the switching element 50 is switched off in the period between the further switching signal time t5 and the further switching signal time t6. This circuit diagram having the further switching signal times t5, t6 is particularly advantageous when other elements are also actuated by the switching element 50, such as a plurality of auxiliary contact current paths in the case of a plurality of electromechanical switches, as will be explained in more detail with reference to FIG. 8.

As can be seen in FIG. 5*c*, the switching position ST42 of the operating contact 42 is checked by the read back logic unit at a first read back time $t_{RL1}$, which is before the first output signal time t1. It is thus possible to check the electromechanical switch 40 or the operating contact 42 before the technical installation is switched on. It is possible to check whether the operating contact 42 has actually closed or switched on, and is not welded, for example. In addition, the first read back time $t_{RL1}$ is after the first switching signal time t3. In other words, the first read back time $t_{RL1}$ is between the first switching signal time t3 and the first output signal time t1. The period in which the switching element 50 is switched on and the auxiliary contact 44 is not yet open is thus used for reading back. In order to allow even more precise checking of the operating contact 42 when the installation is switched on, the switching position ST42 can additionally be checked by the read back logic unit at a further read-back time $t_{RL3}$, as shown in FIG. 5*c*. It is thus possible to ensure that the switching position ST42 has actually changed and a positive edge is present.

As can also be seen in FIG. 5*c*, the switching position of the operating contact 42 is checked by the read back logic unit at a second read back time $t_{RL2}$, which is after the second output signal time t2. It is thus possible for the electromechanical switch 40 or the operating contact 42 to be checked after the technical installation is switched off. It is thus possible to check whether the operating contact 42 is actually opened or switched off, and is not welded, for example. In addition, the second read back time $t_{RL2}$ t is before the second switching signal time t4. In other words, the second read back time tRL2 is between the second output signal time t2 and the second switching signal time t4. The period in which the switching element 50 is switched on and the auxiliary contact 44 is open again is thus used for reading back.

Persons skilled in the relevant art understand that the options explained with reference to FIG. 5*c* for the read back times can be implemented not only in connection with the specific circuit diagram from FIG. 5 but also independently thereof. Furthermore, the read back logic unit may be designed to cyclically check the switching position ST42 of the operating contact. By way of example, a read back time can take place at least once per cycle. The switching state of the operating contact can thus be detected at least once per cycle. This can be used particularly when the safety switching apparatus 1 is being used for a programmable controller, such as that distributed by the applicant of the present invention under the trademark PSS®. In such a safety programmable logic controller (PLC), the communication can take place cyclically.

Figure 6:
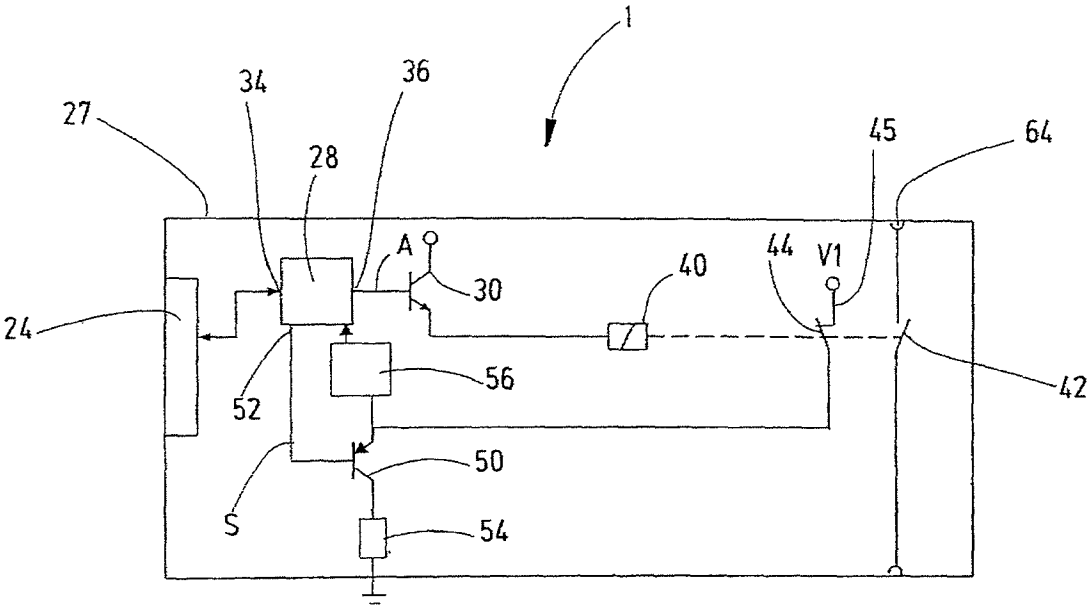
FIG. 6 shows a simplified illustration of a third exemplary embodiment of the novel safety switching apparatus.
Figure 7:
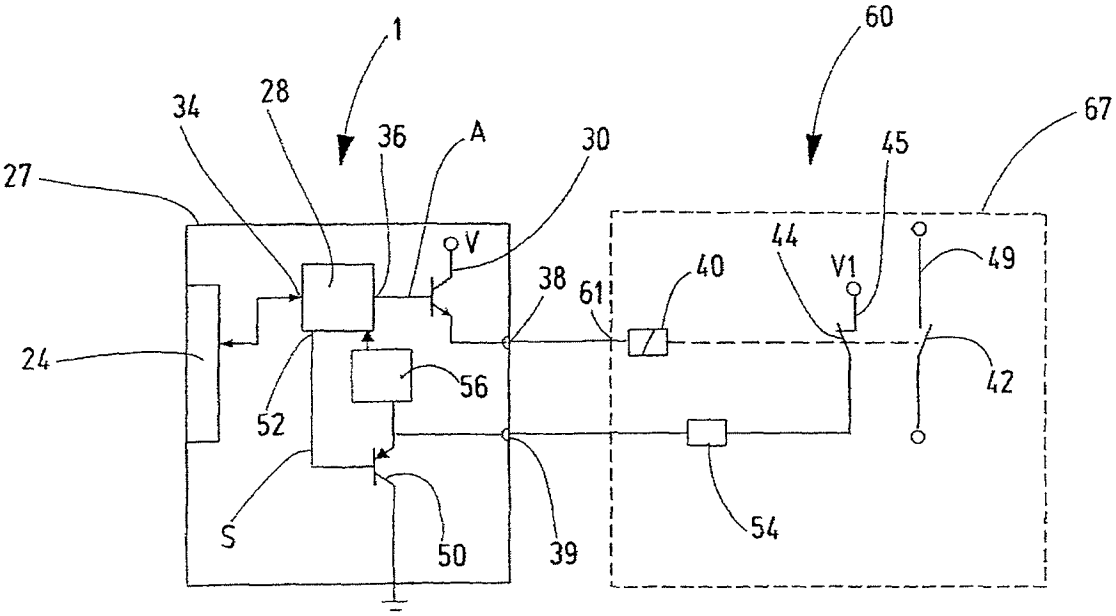
FIG. 7 shows a simplified illustration of a fourth exemplary embodiment of the novel safety switching apparatus or the safety switching system.

FIG. 6 shows a simplified illustration of a third exemplary embodiment of the novel safety switching apparatus 1, and FIG. 7 shows a simplified illustration of an alternative, fourth exemplary embodiment of the novel safety switching apparatus 1. The comments relating to the previously cited figures likewise relate to the exemplary embodiments in FIG. 6 or FIG. 7. In the exemplary embodiment in FIG. 6, the safety switching apparatus 1 contains the electromechanical switch 40. The electromechanical switch 40 with its operating contact 42 and auxiliary contact 44 is thus part of the safety switching apparatus. The electromechanical switch 40, as can be seen in FIG. 6, is arranged within the housing 27 of the safety switching apparatus 1. There is an output terminal 64 in the housing 27, said output terminal being able to be connected to the load circuit 49 of the technical installation 10. This allows the technical installation to be switched on or off directly. The safety switching apparatus 1 can be connected directly to the load circuit 49.

In the alternative exemplary embodiment in FIG. 7, the safety switching apparatus 1 has an output terminal 38, arranged on the housing 27 of the safety switching apparatus 1 and connected to the first output 36, for actuating the electromechanical switch 40. In this case, the electromechanical switch 40 is thus not part of the safety switching apparatus 1 and is not arranged within the housing 27 of the safety switching apparatus 1. In the exemplary embodiment in FIG. 7, the electromechanical switch 40 with its operating contact 42 and auxiliary contact 44 is arranged in a switching apparatus 60 which is arranged so as to be separate from the safety switching apparatus 1. This allows the technical installation to be switched on or off indirectly by the safety switching apparatus 1. The safety switching apparatus 1 and the switching apparatus 60 together form the safety switching system. The switching apparatus 60 arranged separately has an input terminal 61, arranged on a housing 67 of the switching apparatus 60, for receiving the output signal A or the voltage potential V resulting therefrom from the device connection 38 of the safety switching apparatus 1. In addition, the switching apparatus 60 has the load element 54. It should be understood that the load element may alternatively also be arranged in the safety switching apparatus 1. In this exemplary embodiment, the safety switching apparatus 1 has an input 39 for receiving the voltage potential V1 switched by the auxiliary contact 44.

Although the failsafe control/evaluation unit 28 is presented as one unit in the preceding exemplary embodiments in FIGS. 2 to 7, it should be understood that the control/evaluation unit 28 may generally also contain at least two processing units or microcontrollers 28*a*, 28*b* which can process the input signal redundantly with respect to one another, as explained with reference to FIG. 1. The safety switching apparatus 1 then has two redundant signal processing channels. Accordingly, each control/evaluation unit 28 then has two first outputs 36*a*, 36*b* for transmitting an output signal A to a respective electromechanical switch 40*a*, 40*b*. In this case, the operating contacts 42*a*, 42*b* of the electromechanical switches 40*a*, 40*b* are usually connected in series with one another in a load circuit 49, and the auxiliary contacts 44*a*, 44*b* are connected in series with one another in an auxiliary contact current path 45, as explained with reference to FIG. 1. The electromechanical switches 40*a*, 40*b* are therefore actuated redundantly with respect to one another. This is accomplished by means of the redundant outputs 36*a*, 36*b* of the control/evaluation unit. Alternatively or additionally, the outputs of the control/evaluation unit may also be two logically isolated outputs, however, as explained below with reference to FIG. 8 or FIG. 9.

Figure 8:
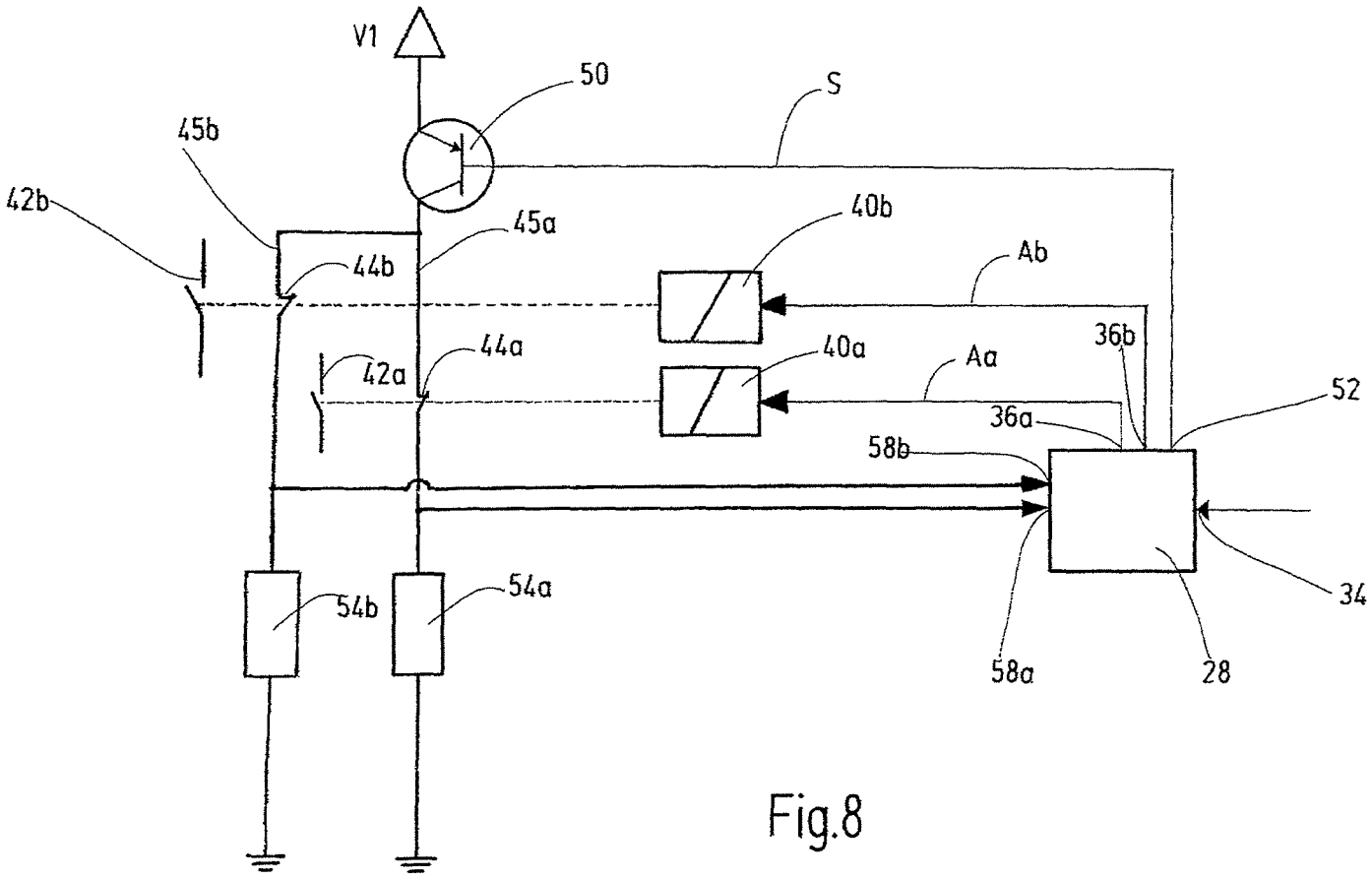
FIG. 8 shows a simplified illustration of a fifth exemplary embodiment of the novel safety switching apparatus.
Figure 9:
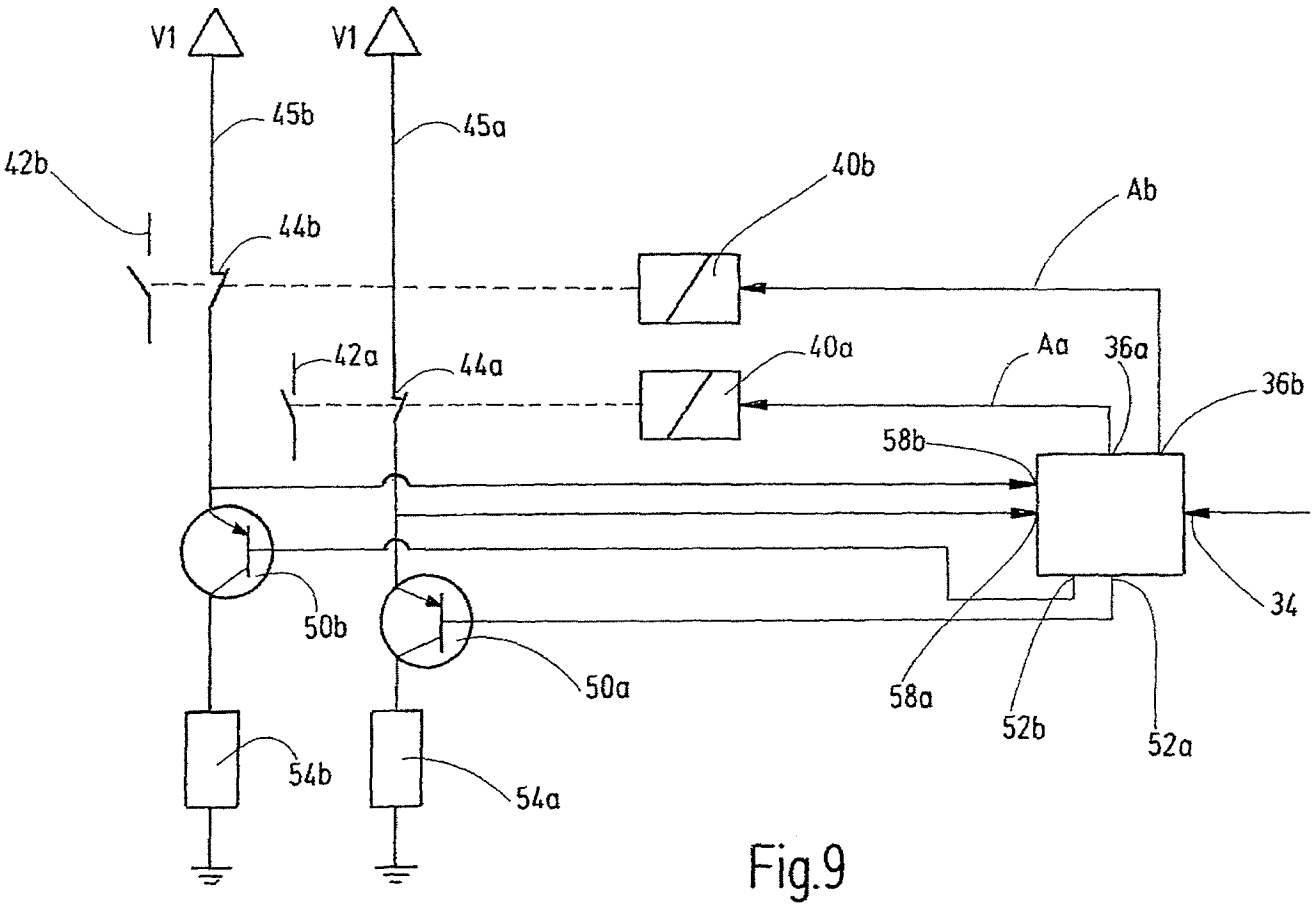
FIG. 9 shows a simplified illustration of a sixth exemplary embodiment of the novel safety switching apparatus.

FIG. 8 shows a simplified illustration of a fifth exemplary embodiment of the novel safety switching apparatus 1, and FIG. 9 shows a simplified illustration of a sixth exemplary embodiment of the novel safety switching apparatus 1. The comments relating to the previously cited figures likewise apply to the exemplary embodiments in FIG. 8 or FIG. 9. In the exemplary embodiment in FIG. 8 or FIG. 9, the failsafe control/evaluation unit 28 has at least two first outputs 36*a*, 36*b* for transmitting a respective output signal Aa, Ab to a respective electromechanical switch 40*a*, 40*b*. The first outputs 36*a*, 36*b* are two logically isolated outputs in the exemplary embodiment in FIG. 8 or FIG. 9. In this case, the operating contacts 42*a*, 42*b* and the auxiliary contacts 44*a*, 44*b* are not connected in series with one another. Each auxiliary contact 44*a*, 44*b* is arranged in a separate auxiliary contact current path 45*a*, 45*b* in this case, as can be seen in FIG. 8 or FIG. 9. Each operating contact 42*a*, 42*b* is also arranged in a dedicated load circuit. In FIG. 8 or FIG. 9, the operating contacts 42*a*, 42*b* are checked individually or independently of one another. In this regard, second inputs 58*a*, 58*b*, of the read back logic unit or of the control/evaluation unit 28 are provided. The second inputs 58*a*, 58*b* each receive a read-back signal for checking the switching position of one of the operating contacts 42*a*, 42*b*.

In the exemplary embodiment shown in FIG. 8, the switching element 50 is arranged in each of the auxiliary contact current paths 45*a*, 45*b* of the auxiliary contacts 44*a*, 44*b* of the electromechanical switches 40*a*, 40*b*. In other words, the switching element 50 is arranged both in the first auxiliary contact current path 45*a* with the first auxiliary contact 44*a* and in the second auxiliary contact current path 45*b* with the second auxiliary contact 44*b*. Thus, a single switching element 50 is used for the two auxiliary contact current paths 45*a*, 45*b* of the two electromechanical switches 40*a*, 40*b*. The switching element 50 is in this case arranged between the defined voltage V1 and the two auxiliary contacts 44*a*, 44*b*. This exemplary embodiment in FIG. 8 can be used particularly in conjunction with the circuit diagram for the switching state ST50 or for the switching signal S in FIG. 5, in which the switching element 50 is switched off after the installation is switched on, and is switched on again before the installation is switched off. This ensures that no element in another auxiliary current path can consume energy in the period between the further switching signal time t5 and the further switching signal time t6, in which the switching element 50 is switched off.

In the alternative exemplary embodiment in FIG. 9, on the other hand, the safety switching apparatus 1 has two switching elements 50*a*, 50*b*, which are respectively arranged in one of the auxiliary contact current paths 45*a*, 45*b* from the auxiliary contact current paths 45*a*, 45*b* of the auxiliary contacts 44*a*, 44*b* of the electromechanical switches 40*a*, 40*b*. In other words, the first switching element 50*a* is arranged in the first auxiliary contact current path 45*a* with the first auxiliary contact 44*a*, and the second switching element 50*b* is arranged in the second auxiliary contact current path 45*b* with the second auxiliary contact 44*b*. Thus, one switching element 50*a*, 50*b* is respectively used for each auxiliary contact current path 45*a*, 45*b* of each of the two electromechanical switches 40*a*, 40*b*.

What is claimed is:

1. A safety switching apparatus for switching on or off a technical installation in a failsafe manner, comprising:

a failsafe control/evaluation unit having an input for receiving an input signal representative of the technical installation and having a first output for providing an output signal as a function of the input signal, and having a second output for providing a second output signal as a function of the input signal, a first electromechanical switch having a first operating contact for connecting or disconnecting a load current to the technical installation, and having a first auxiliary contact mechanically coupled with the first operating contact in order to establish a first auxiliary contact current path which is electrically isolated from the first operating contact, a second electromechanical switch having a second operating contact for connecting or disconnecting the load current to the technical installation, and having a second auxiliary contact mechanically coupled with the second operating contact in order to establish a second auxiliary contact current path which is electrically isolated from the second operating contact, and a switching element arranged in both the first and the second auxiliary contact current paths, wherein the first output is coupled to the first electromechanical switch for driving the first operating contact in response to the first output signal at a defined first output signal time, wherein the second output is coupled to the second electromechanical switch for driving the second operating contact in response to the second output signal at a defined second output signal time, wherein the failsafe control/evaluation unit is designed for checking the switching position of the first and second operating contacts by monitoring the first and second auxiliary contact current paths, wherein the failsafe control/evaluation unit is further designed to produce a switching signal at a defined switching signal time which is different from the first and second output signal times, and wherein the switching element is driven in response to the switching signal in order to selectively allow or interrupt an auxiliary current flow in the first and second auxiliary contact current paths.

2. The safety switching apparatus of claim 1, wherein the failsafe control/evaluation unit is designed to produce the first output signal in the form of a switch-on signal for switching on the load current at a first output signal time, and to produce the switching signal for allowing the auxiliary current flow in the first auxiliary contact current path at a first switching signal time, which is before the first output signal time.

3. The safety switching apparatus of claim 2, wherein the failsafe control/evaluation unit is further designed to switch off the switching element at a further switching signal time, which is after the first output signal time.

4. The safety switching apparatus of claim 2, wherein the failsafe control/evaluation unit is designed to produce the first output signal in the form of a switch-off signal for switching off the load current at a second output signal time, and to produce the switching signal for interrupting the auxiliary current flow in the first auxiliary contact current path at a second switching signal time, which is after the second output signal time.

5. The safety switching apparatus of claim 4, wherein the failsafe control/evaluation unit is further designed to switch on the switching element at a third switching signal time, which is before the second output signal time.

6. The safety switching apparatus of claim 1, further comprising a read back logic unit having a read back input connected to the first auxiliary contact current path for receiving a read back signal for checking the switching position of the first operating contact.

7. The safety switching apparatus of claim 6, wherein the read back logic unit is designed to check the switching position of the first operating contact at a first read back time, which is after the switching signal time and before the first output signal time.

8. The safety switching apparatus of claim 6, wherein the read back logic unit is designed to check the switching position of the operating contact at a second read back time, which is after the first output signal time.

9. The safety switching apparatus of claim 1, further comprising a load element arranged in the first and second auxiliary contact current paths for setting a defined current through the first and second auxiliary contact current paths when a defined monitoring voltage is applied.

10. The safety switching apparatus of claim 1, wherein the switching element is an electronic switching element.

11. In a technical installation comprising an electrical load selectively supplied with a load current, comprising at least one signaling device for providing an input signal, comprising a first electromechanical switch having a first operating contact for connecting or disconnecting the load current and having a first auxiliary contact mechanically coupled with the first operating contact in order to establish a first auxiliary contact current path which is electrically isolated from the first operating contact, and comprising a second electromechanical switch having a second operating contact for connecting or disconnecting the load current and having a second auxiliary contact mechanically coupled with the second operating contact in order to establish a second auxiliary contact current path which is electrically isolated from the second operating contact, a safety switching apparatus comprising:

a failsafe control/evaluation unit having an input for receiving the input signal, having a first output for providing a first output signal as a function of the input signal, and having a second output for providing a second output signal as a function of the input signal, a first switching element arranged in the first auxiliary contact current path, and a second switching element arranged in the second auxiliary contact current path, wherein the first output is coupled to the first electromechanical switch for driving the first operating contact in response to the first output signal at a defined first output signal time, wherein the second output is coupled to the second electromechanical switch for driving the second operating contact in response to the second output signal at a defined second output signal time, wherein the failsafe control/evaluation unit is designed for checking the switching positions of the first and second operating contacts by monitoring the first and second auxiliary contact current paths, respectively, wherein the failsafe control/evaluation unit is further designed to produce a first and a second switching signal at a defined first and second switching signal times which are different from the first and second output signal times, and wherein the first and second switching elements are driven in response to the first and second switching signals in order to selectively allow or interrupt a respective auxiliary current flow in the first and second auxiliary contact current paths.

12. The safety switching apparatus of claim 11, further comprising a housing where the failsafe control/evaluation unit and the switching element are accommodated.

13. A method for operating a failsafe control/evaluation unit of a safety switching apparatus comprising the following steps:

receiving an input signal at an input of the failsafe control/evaluation unit, processing the input signal in order to produce, in dependence thereon, a first and a second output signal for switching on or off a load current at a defined output signal time, and transmitting the first and second output signals to a first and a second electromechanical switch, respectively, wherein the first and second electromechanical switches have an operating contact for switching a load circuit of the technical installation and each have a positively guided auxiliary contact in a respective auxiliary contact current path, which auxiliary contacts can be used to carry a current for checking the switching position of the respective first and second operating contacts, producing a switching signal at a defined switching signal time which has a time gap relative to the output signal time, and transmitting, from a further output of the control/evaluation unit, the switching signal to a switching element arranged in the respective auxiliary contact current paths in order to selectively allow a monitoring current through the respective auxiliary contact current paths.

* * * * *